US006129567A

United States Patent [19]

Gaupp et al.

[11] Patent Number: 6,129,567

[45] Date of Patent: Oct. 10, 2000

[54] CONNECTOR ASSEMBLY HAVING AN ACTUATING SLIDE

[75] Inventors: Peter Gaupp, Dieburg; Dietrich Wilhelm Kuempel, Rüsselsheim, both of Germany

[73] Assignee: The Whitaker Corporation, Wilmington, Del.

[21] Appl. No.: 09/024,255

[22] Filed: Feb. 17, 1998

[30] Foreign Application Priority Data

Mar. 6, 1997 [DE] Germany ..... 197 09 198

[51] Int. Cl.[7] ..... H01R 13/62

[52] U.S. Cl. ..... 439/157

[58] Field of Search ..... 439/157, 347, 439/152–156, 158–160

[56] References Cited

U.S. PATENT DOCUMENTS

| | | | |
|---|---|---|---|
| 5,171,156 | 12/1992 | Nagasaka et al. | 439/157 |
| 5,839,912 | 11/1998 | Schekalla et al. | 439/157 |

FOREIGN PATENT DOCUMENTS

| | | |
|---|---|---|
| 0 587 174 A2 | 3/1994 | European Pat. Off. . |
| 0 726 619 A1 | 8/1996 | European Pat. Off. . |
| 37 30 020 C1 | 9/1988 | Germany . |
| 38 26 332 C1 | 8/1989 | Germany . |

*Primary Examiner*—Paula Bradley
*Assistant Examiner*—Tho D. Ta

[57] ABSTRACT

A connector assembly having a first electrical connector with an actuating slide and a second, complementary connector, where the actuating slide is integrated into the first connector and co-operates with the second connector in order to plug the connector pair together, at least one pin being moved through a guide groove during the actuation of the actuating slide in order to connect the connectors, and the pin being moved in the opposite direction through the guide groove during the actuation of the actuating slide in order to separate the connectors, the actuating slide and the first electrical connector having complementary guide means which guide the actuating slide essentially on a circular track during the actuation.

7 Claims, 6 Drawing Sheets

CONNECTOR ASSEMBLY HAVING AN ACTUATING SLIDE

BACKGROUND OF THE INVENTION

1. Field of the Invention

The invention relates to a connector assembly having a first electrical connector with an actuating slide and having a second, complementary connector, the actuating slide being integrated into the first connector and cooperating with the second connector in order to plug the connector pair together.

2. Description of the Prior Art

Electrical connectors having a multiplicity of electrical contacts are connected to complementary connectors and then form a connector pair. The higher the number of contacts to be connected, the larger the force which is required to produce a connection between the connectors. It is known to use mechanical aids in order to interconnect the two connectors of the connector pair. These mechanical aids can be constructed either as actuating slides or in the form of a lever. Actuating slides are normally moved in a direction transverse to the plug-in direction of the connector. In this case, the actuating slide is integrated in one of the connectors, and has either a guide groove or a guide slot or a pin, the connector to be connected then carrying the complementary part. When the two connectors are joined, the actuation of the actuating slide forces the pin to move through the guide groove or the guide slot.

EP 587 174 A2 discloses an electrical connector assembly, in particular for door connectors in automobiles. The connector assembly has an insulating housing and an actuating slide which is constructed in a U-shaped fashion, that is to say two parts of elongated design, the limbs of the U, and means for actuating at their end, the base of the U. The connector housing is brought into the mating end position by actuating the actuating slide. In this assembly, the actuating slide has two slots on each flank of the U. The pins, which are arranged on the connector housing move in these slots.

In order to interconnect the two complementary connectors, the actuating slide must be in a first position, the entrance position. During the joining operation, the actuating slide is then brought into a second position, the final latched position. The two connectors are interconnected in this position.

In connector assemblies with two complementary connectors, one of the connectors frequently has a circumferential collar into which the other is inserted. Actuating slides as disclosed in EP 587 174 A2 can be used only if the collar has corresponding openings.

SUMMARY OF THE INVENTION

It is the object of the invention to specify an electrical connector assembly having an actuating slide that can be used with connectors which have a closed circumferential collar.

The object is achieved by means of a connector assembly having the following features: a first electrical connector with an actuating slide which has at least one part of elongated construction with, at one end, means for actuating, and a second, complementary connector, the actuating slide being integrated into the first connector and co-operating with the second connector in order to plug the connector pair together, at least one pin being moved through a guide groove during the actuation of the actuating slide in order to connect the connectors, and the pin being moved in the opposite direction through the guide groove during the actuation of the actuating slide in order to separate the connectors, the actuating slide and the first electrical connector having complementary guide means which guide the actuating slide essentially on a circular track during the actuation.

The connector assembly includes a first electrical connector, a second complementary connector and an actuating slide. This slide comprises at least one part of elongated construction which has at least one guide groove or one guide slot or one pin. The elongated part is curved in the longitudinal direction and is moved along a curved line. The actuating slide is not inserted perpendicular to the plug-in direction, but from a lateral corner or the top side of the first connector, and is then inserted into the first electrical connector on an basically circular track. It is thereby possible for the first electrical connector to be inserted into a second, complementary electrical connector having a circumferential collar and for the circumferential collar to be closed.

It is particularly advantageous to construct the pins on the inner side of the collar and to construct corresponding guide grooves or guide slots on the actuating slide. If a plurality of pins are provided, they should be arranged mutually offset in the plug-in direction in such a way that they simultaneously dip into the guide grooves of the actuating slide. It is also necessary for the part in which the actuating slide is guided to have corresponding grooves, in order to permit the pins to be inserted into the guide grooves of the actuating slide. Provided on the actuating slide and on the first electrical connector are complementary guide means which guide the actuating slide on the circular track during the actuation. These complementary guide means are constructed in the shape of a circular arc. At least the part of the actuating slide is constructed like a segment of a circular arc. Using a plurality of pins is particularly expedient in order to ensure uniform guidance.

The actuating slide can have very varied appearances. It can, for example, comprise a single curved part which is of elongated construction, has, at one end, means for actuating, and is guided in the shape of a circular arc in appropriate guide means. However, it can also be constructed in a U-shaped fashion with two corresponding curved parts of elongated construction and one part which connects them and constitutes the means for actuating. The respective construction essentially depends on the requirements placed on the actuating slide, which in turn depend on how the corresponding electrical connector is constructed. In the case of a very narrow and long connector, it is certainly advantageous to provide an actuating slide made from a single elongated part.

It is, for example, also possible for a connector to have a plate-type contact-ensuring device which is arranged on one side of the electrical connector. This plate-type contact-ensuring device can be used to have the complementary guide means, in which the actuating slide is guided correspondingly. The plate-type contact-ensuring device does have grooves to permit the pins to enter the grooves of the actuating slide. If the contact ensuring device is not in its end position, the pins cannot enter the grooves and the complementary connectors cannot be mated.

It is particularly advantageous for a connector to have a circumferential collar which is essentially closed when a water-tight design of a connector is involved. When a long narrow connector is involved, the collar thus provides the necessary stability. In the case of such a connector, as well, it is possible, with the connector assembly according to the invention, to facilitate the actuation by means of an actuating slide. The use of an inventive actuating slide does not add very much to the space necessary for the connector.

DETAILED DESCRIPTION OF THE PREFERRED EMBODIMENT

Figure 1:
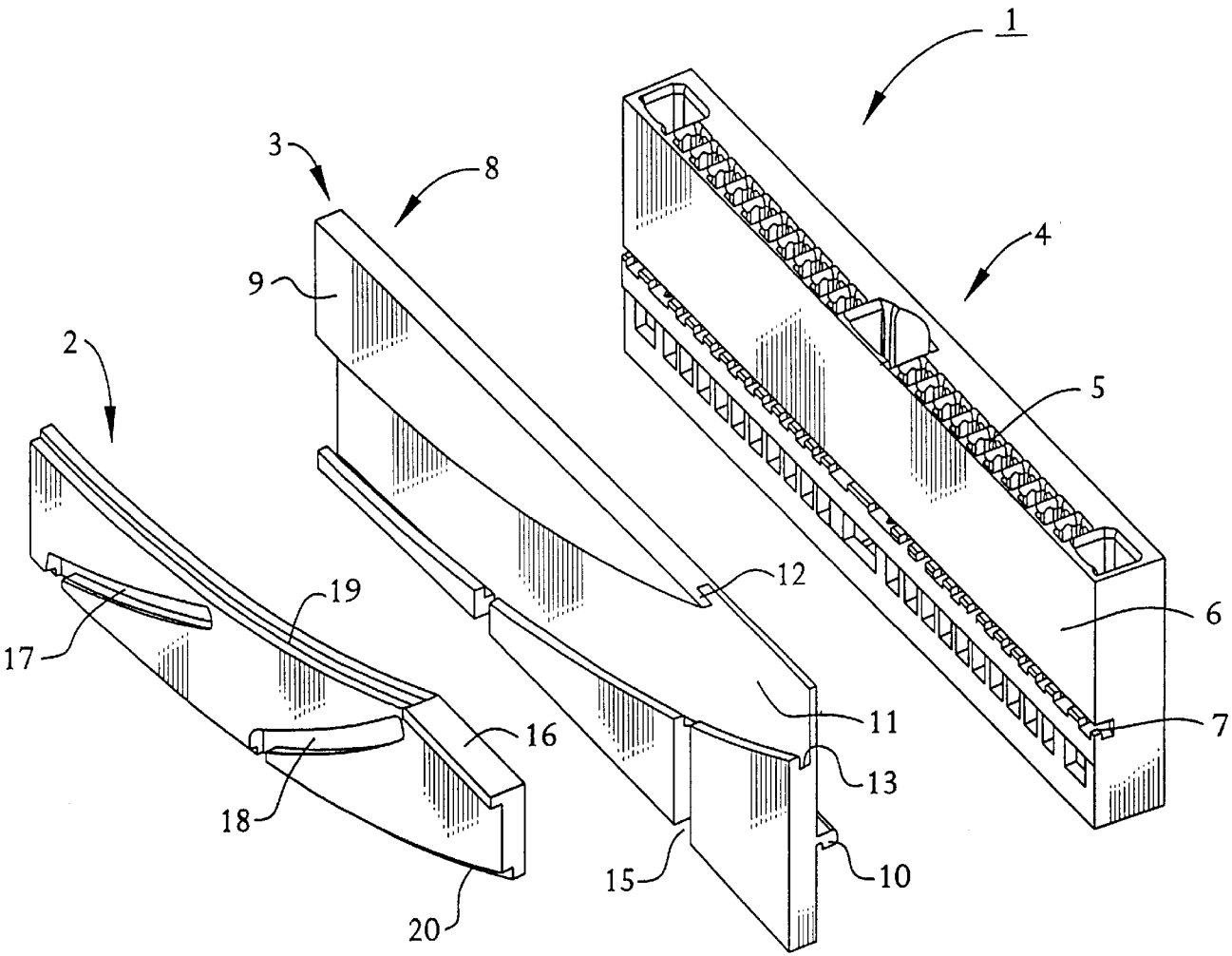
FIG. 1 shows an exploded perspective view of a first connector according to the present invention.
Figure 2:
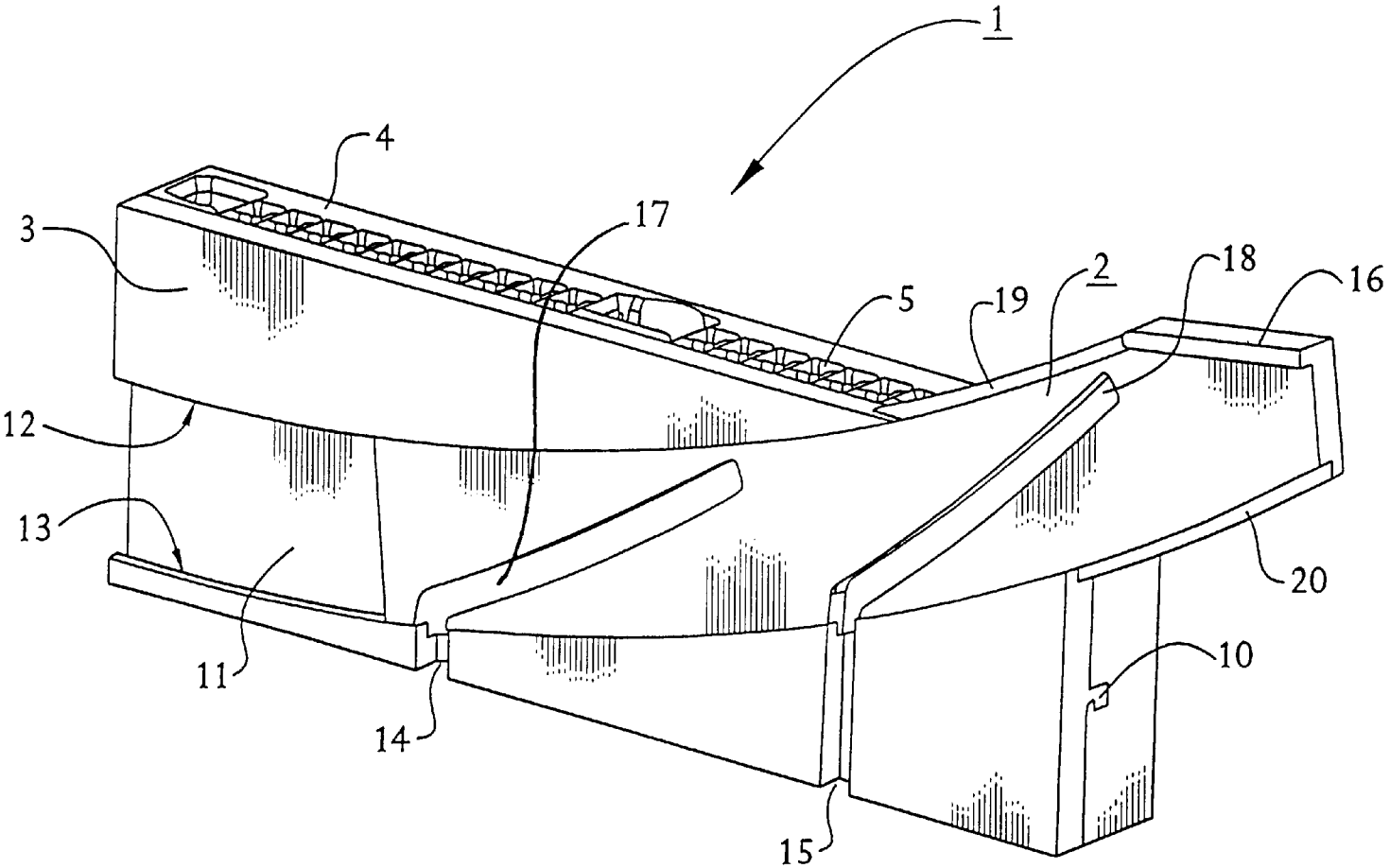
FIG. 2 shows a perspective view of the first connector of FIG. 1 with a partially inserted actuating slide.
Figure 3:
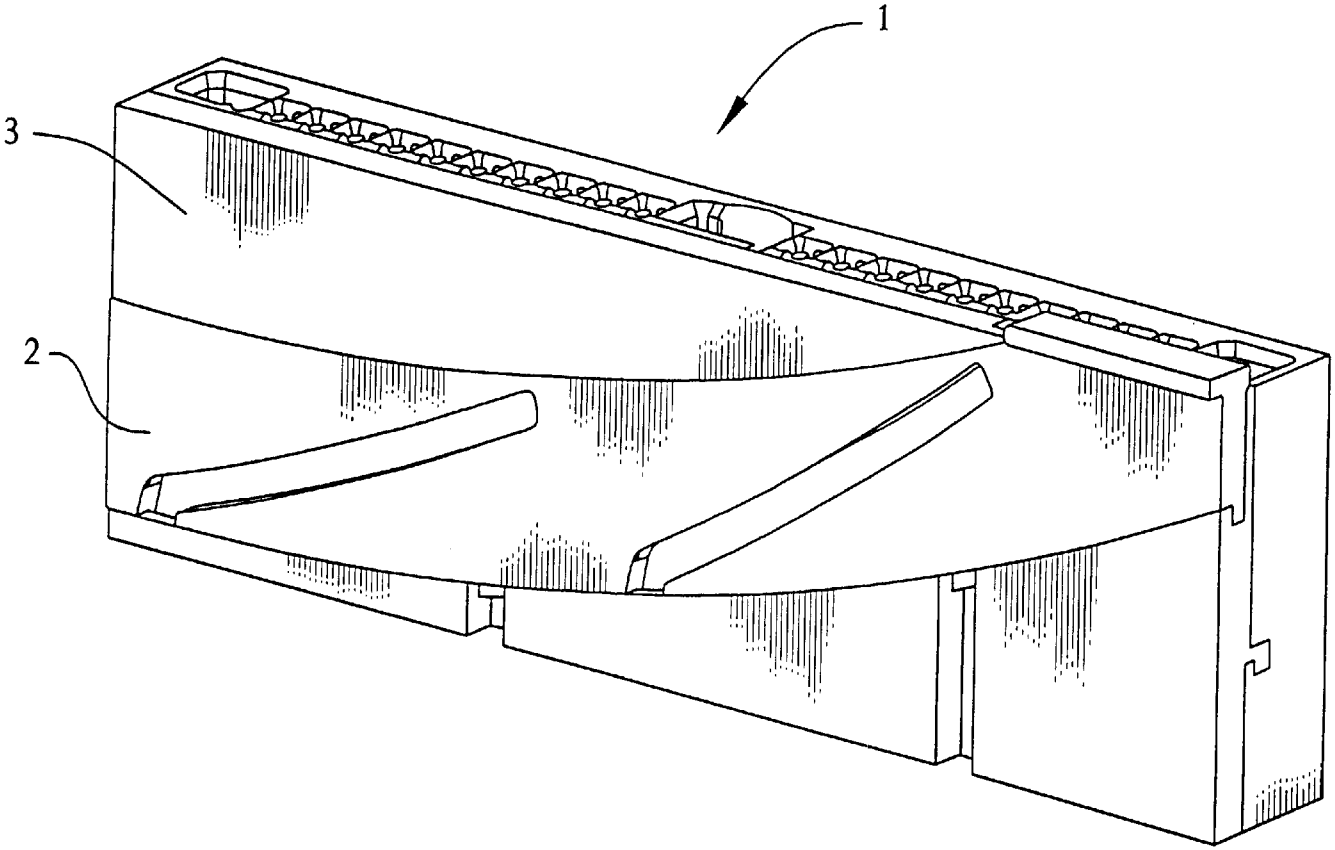
FIG. 3 shows a perspective view corresponding to FIG. 2 with the first connector with a fully inserted actuating slide.

The first electrical connector 1 is shown in FIGS. 1 to 3. FIG. 1 shows an exploded view with an actuating slide 2, a plate-shaped contact-ensuring device 3 and a chamber housing 4. The chamber housing 4 has individual contact chambers 5 which are of different sizes. Corresponding electrical contacts (not shown) can be inserted into the contact chambers 5. A longitudinal groove 7 is provided on one side 6 of the chamber housing 4. The longitudinal groove 7 extends transversely relative to the plug-in direction. It is formed in such a way that it is connected to each of the individual chambers 5.

The contact-ensuring device 3 is essentially constructed in a plate-shaped fashion with two flat sides 8 and 9. Located on the flat side 8, facing the chamber housing 4, is a web 10 which extends like a rail in the transverse direction over the contact-ensuring device 3. The contact-ensuring device 3 can now be pushed laterally with the web 10 into the groove 7. The web 10 then engages each of the chambers 5. The contacts located therein will be secured in the chambers 5.

On the other flat side 9 of the contact device 3, there is a depression 11 in the shape of a circular arc with guide means 12 and 13 in the form of rails which are arranged at each edge of the depression 11. Furthermore, the contact-ensuring device 3 has, on the flat side 9, two grooves 14 and 15 (best seen in FIG. 2), which extend parallel to the plug-in direction, serve to receive pins 23,24 on a second connector 21 (FIGS. 4, 5) and end in the depression 11.

The actuating slide 2 is of elongated construction and has, at one end, a grip 16 for actuating. Furthermore, the actuating slide 2 has two guide grooves 17, 18. The part of elongated construction looks like the segment of a circular arc having the shape of a plate where, on each of the bent longitudinal sides, guide means 19, 20 which are complementary to the guide means 12, 13 on the second contact-ensuring device 3 are formed.

As illustrated in FIG. 2, the contact-ensuring device 3 can be pushed onto the chamber housing 4. The contacts would now be secured in the chambers 5 by the web 10. The actuating slide 2 engages with guide means 19, 20 in the corresponding complementary guide means 12, 13 of the second contact-ensuring device 3. The actuating slide 2 moves in the depression 11 when being displaced. When moving, it essentially describes a segment of a circular track.

Represented in FIG. 2 is a preliminary latched position, in which the actuating slide 2 is latched with the contact-ensuring device 3 by means of latching means, which are not shown. In this preliminary latched position, the pins of the second connector can firstly be inserted, through the grooves 14, 15 of the contact-ensuring device 3, into the guide grooves 17, 18 of the actuating slide 2. The actuating slide 2 is handled by the grip 16 in order to be actuated.

The final latched position of the actuating slide 2 in the contact-ensuring device 3 and in the first connector 1 is represented in FIG. 3. The actuating slide 2 is received fully by the depression 11. Owing to the circular movement which the actuating slide 2 describes, it is not necessary to bring the latter into its end position from the side; rather it is inserted from the corner or else from above.

Figure 4:
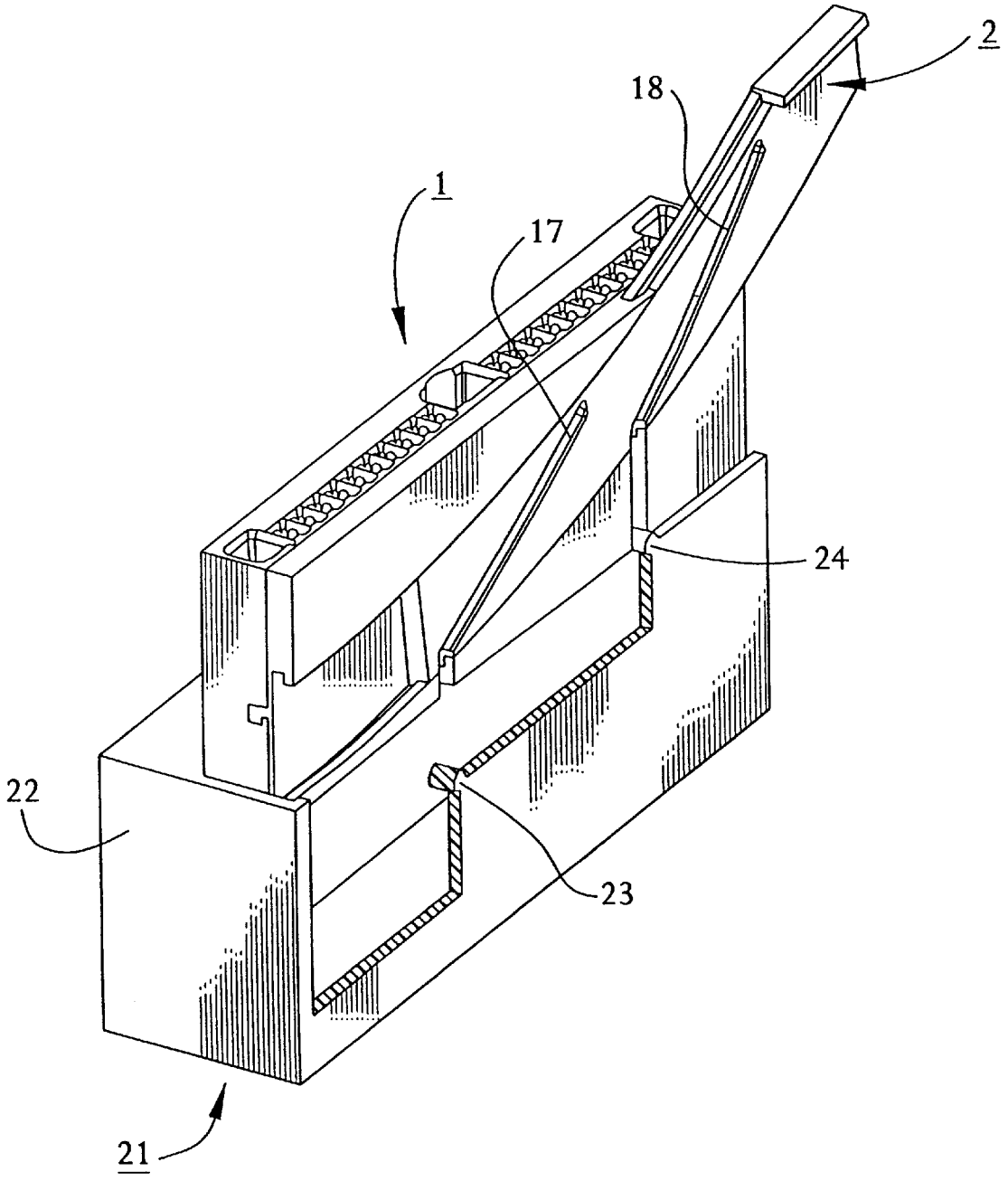
FIG. 4 shows a perspective view of the first connector, the collar of the second connector, which is partly cut away, during mating.

FIG. 4 shows the co-operation of the first connector 1 with a second connector 21. In this case, all that is shown of the second connector 21 is the collar 22, in which the first connector 1 is held. This collar 22 is essentially closed all the way round. In the illustration it is cut away so that the position of pins 23,24 can be seen. The two pins 23, 24 are not only arranged mutually offset perpendicular to the plug-in direction, but are also arranged mutually offset in the plug-in direction. This results in that the two pins 23 and 24 dipping simultaneously into the guide grooves 17, 18 of the actuating slide 2, when the first connector 1 is inserted into the second connector 21.

Figure 5:
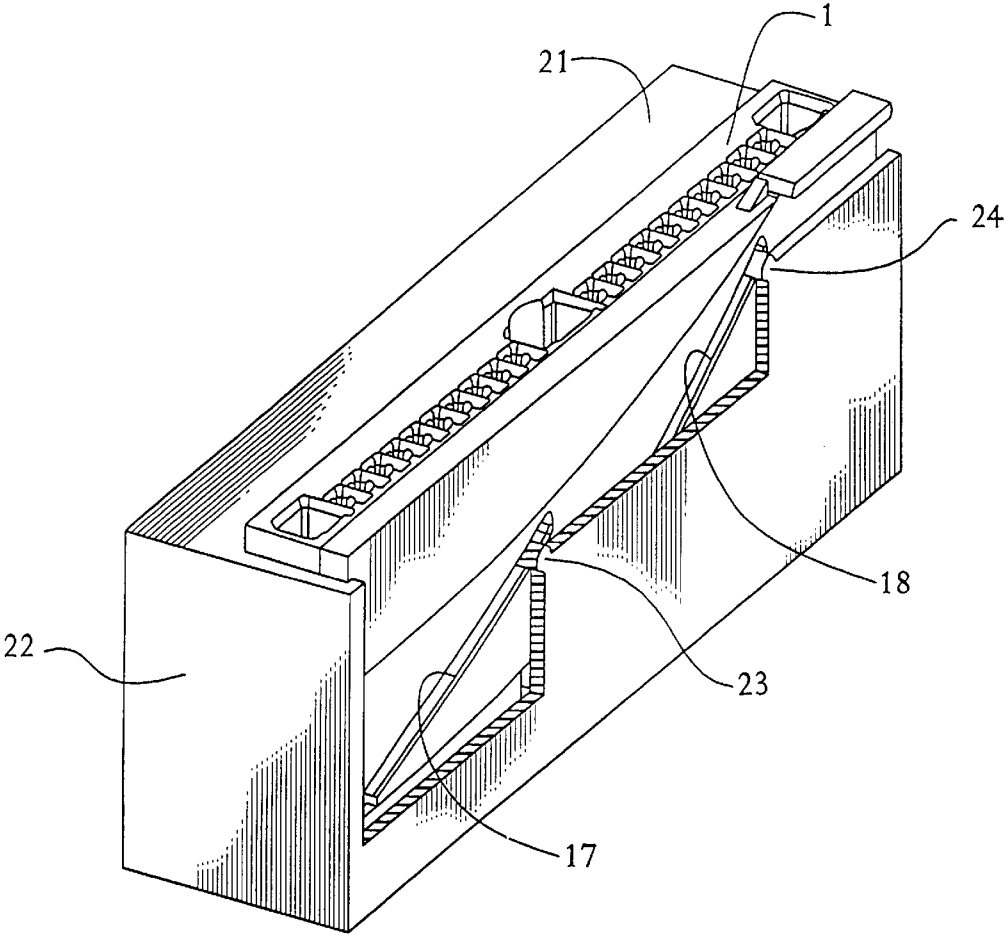
FIG. 5 shows a perspective view corresponding to FIG. 4 with the connectors being fully mated into the collar of the second connector.
Figure 6:
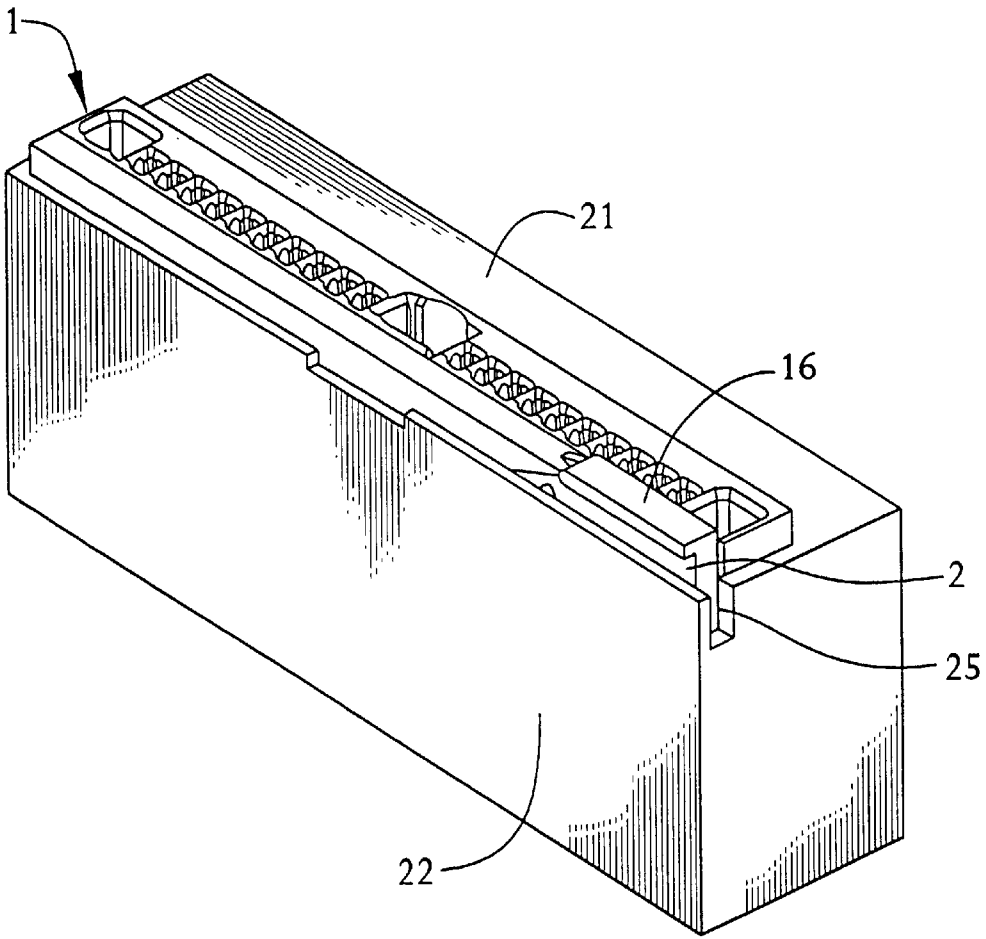
FIG. 6 shows an upper perspective view of the mated connector assembly.

The state in which the first connector 1 has been inserted into the second connector 21 is represented in FIGS. 5 and 6. In FIG. 5, the collar 22 of the second connector 21 is once again cut away. It is clearly to be seen that the two pins 23 and 24 are located approximately at the end of the guide grooves 17 and 18. As is also clearly seen from FIG. 6 where, the collar 22 is completely closed except for a small slot 25. The actuating slide 2 is easily accessible via the grip 16, even when it is in the completely inserted position.

We claim:

1. In combination, a first electrical connector assembly and a second complimentary connector, said first electrical connector assembly comprising an actuating slide with at least one part of elongated construction with, at one end, means for actuating;

said second complimentary connector having an essentially closed circumferential collar having an inner surface for receiving the first electrical connector assembly, with at least one pin positioned on said inner surface of said collar, the actuating slide being integrated into an arcuate depression of the first connector assembly and co-operating with said at least one pin of the second connector in order to plug the connectors together, said at least one pin being moved through a guide groove in the actuating slide during the actuation of the slide in order to connect or separate the connectors, the actuating slide and the arcuate depression of the first electrical connector assembly having complimentary guide means which guide the actuating slide essentially on a circular arcuate track during the actuation.

2. The combination according to claim 1, wherein the complementary guide means are constructed in the shape of a circular arc.

3. The combination according to claim 1, wherein the actuating slide or at least the part of the actuating slide of elongated construction is constructed as a segment of a circular arc.

4. The combination according to claim 1, wherein at least two pins are provided on said inner surface of said collar and are mutually offset so that they simultaneously dip into corresponding guide grooves of the actuating slide.

5. The combination according to claim 1, wherein said actuating slide comprising a single slide positioned on one side of the first connector assembly.

6. The combination according to claim 1, wherein the first electrical connector assembly comprises a first electrical connector and a contact-ensuring device, which is laterally arranged and of plate-type construction, is positioned between one side of the first electrical connector and said inner surface of said collar, and is fastened to said first electrical connector to secure electrical contacts therein.

7. The combination according to claim 6, wherein the arcuate depression and the complimentary guide means are constructed in the contact-ensuring device, which is positioned opposite said at least one pin of said inner surface of said collar.

* * * * *